United States Patent [19]

Ross et al.

[11] 4,235,306

[45] Nov. 25, 1980

[54] EMERGENCY ESCAPE DEVICE

[76] Inventors: Larry G. Ross; Lyola J. Ross, both of P.O. Drawer Z, Burney, Calif. 96013

[21] Appl. No.: 7,030

[22] Filed: Jan. 29, 1979

[51] Int. Cl.[3] ..... E06C 1/56; A62B 1/16

[52] U.S. Cl. ..... 182/100; 182/189

[58] Field of Search ..... 182/100, 189, 190, 70–75, 182/76

[56] References Cited

U.S. PATENT DOCUMENTS

| | | | |
|---|---|---|---|
| 195,161 | 9/1877 | Philbrook | 182/190 |
| 300,465 | 6/1884 | Hale | 182/190 |
| 1,118,316 | 11/1914 | Unger | 182/100 |
| 1,321,869 | 11/1919 | Wilson | 182/100 |
| 1,447,182 | 3/1923 | Roberts | 182/100 |
| 2,147,624 | 2/1939 | Briggs | 182/190 |
| 3,871,480 | 3/1975 | Sauri | 182/100 |

*Primary Examiner*—Reinaldo P. Machado
*Attorney, Agent, or Firm*—Herbert C. Schulze

[57] ABSTRACT

This device is an emergency escape apparatus to be utilized in escape from elevated levels of buildings in case of fire, or the like, and incorporates a cord, or the like, including hand-hold elements, together with a window mounting support. It is featured by light weight and ease of use, and is so constructed as to comprise principal mounting bar, mountable within a window casement, wherein the apparatus is always ready for use, contrary to removable and storable ladders, and the like, and wherein the configuration is such that it essentially blends with the window casement and framework and is virtually concealed along an edge of the window.

3 Claims, 10 Drawing Figures

EMERGENCY ESCAPE DEVICE

CROSS REFERENCE TO RELATED PATENT APPLICATIONS

There are no patent applications filed by us related to this application.

BACKGROUND OF THE INVENTION

1. Field of the Invention

This invention is in the general field of devices which may be used for evacuation, or escape, from higher elevations of buildings or other locations. It is primarily designed for such use in emergency situations such as in the case of building fires. The invention is more particularly directed to a device which can be relatively permanently mounted within an existing window casement in a building, or the like. The device is further more particularly directed to an escape means which can be utilized under emergency and panic situations without cumbersome installation such as is the case with most emergency escape ladders, and the like. The device is even more particularly directed to a light-weight escape device which includes a cord, or the like, which can be dropped from a window without any special mounting requirements under emergency situations, which cord is equipped with means for hand and foot hold or support positions for quick, easy, and effective use in descending from upper floors of a building, or the like, along the exterior of the building.

2. Description of the Prior Art

The prior art in this field is somewhat limited. There are such devices as rope ladders, chain ladders, and the like, which can be permanently attached to the exterior of a building or which can be fastened adjacent a window, or the like, at time of emergency and dropped along side the building for evacuation or escape.

The present device encompasses and includes a relatively concealed, permanent but removable, window mounting support together with an easily hand-manipulated cord provided with means for hand hold and foot support at spaced intervals. The present device mounts in such manner as to blend with the window and with the window casement, and is permanently in position so that one of no skill, and without tools of any nature, may use is immediately upon an emergency situation without the necessity of mounting at the time of the emergency.

SUMMARY OF THE INVENTION

A matter of great concern to individuals and authorities constantly is the matter of escape, or evacuation, for individuals trapped on elevations of buildings, or the like, above ground level when fires occur. Each year there are many deaths and many serious injuries attributed to such situations. In general, when a fire breaks out, particularly in an ordinary residential home, or the like, there is no easy and immediately available evacuation or escape means.

We have investigated this problem and have found that the most commonly utilized device for this purpose is a ladder attachable to a window sill, which ladder customarily is made from chain, or the like. In some instances, rope and the like are utilized for such ladders. In some cases, buildings are equipped on the outside with a permanently installed ladder and various types of slides, tubes, funnels, and the like, have been suggested.

There are difficulties with every suggested apparatus for home or similar use for purposes of quick escape or evacuation in the event of an emergency such as fire. The ladders which are sometimes used and attached to the window sill are cumbersome and awkward and must be stored in a somewhat remote area such as under a bed, in a closet, or the like. In an emergency, few persons can reach these as effectively as they should.

When ladders are permanently attached to the exterior of a building, they invite intruders. Additionally, they detract from the appearance of the building. Escape tunnels or tubes have defects similar to those mentioned for both of the above situations.

Notwithstanding the problems existing with escape devices known in the past, many people feel they must have such devices on hand in order to protect against those emergencies which occur with important frequency.

With the foregoing in mind, we have studied this problem and have now conceived and developed a unique apparatus for emergency escape from a building and for descent adjacent an exterior wall surface.

The device we have developed comprises a totally unobtrusive bar with effective mounting arrangements for mounting permanently adjacent a window. In connection with the bar there is an escape cable of light weight and high strength which has a number of hand holds, or the like, at conveniently spaced intervals which serve the dual purpose of being foot supports also. This apparatus is easily handled by a child or an adult and is designed for maximum efficiency under all circumstances.

An object of this invention is to provide an escape device for convenient escaping from elevated levels of a building, or the like, under emergency circumstances.

Another object of this invention is to provide such a device as hereinabove set forth wherein the device includes a single cable or cord (multiple cables or cords may be used in alternate situations) having a multiplicity of hand hold devices at spaced intervals for allowing careful and safe descent along the exterior of a building.

Another object of this invention is to provide such a device as described wherein means are incorporated for maintaining the cable or cord at a spaced distance from the building in order to facilitate safe descent.

Another object of this invention is to provide such a device as described wherein the device may be permanently (although removably) installed within a window casement in such manner as to be unobtrusive when not being used.

Another object of this invention is to provide such a device as described wherein no special instructions need be followed for the use of the device.

The foregoing and other objects and advantages will become apparent to those skilled in the art upon reading the following description of a preferred embodiment in conjunction with a review of the appended drawings.

DESCRIPTION OF A PREFERRED EMBODIMENT

Figure 1:
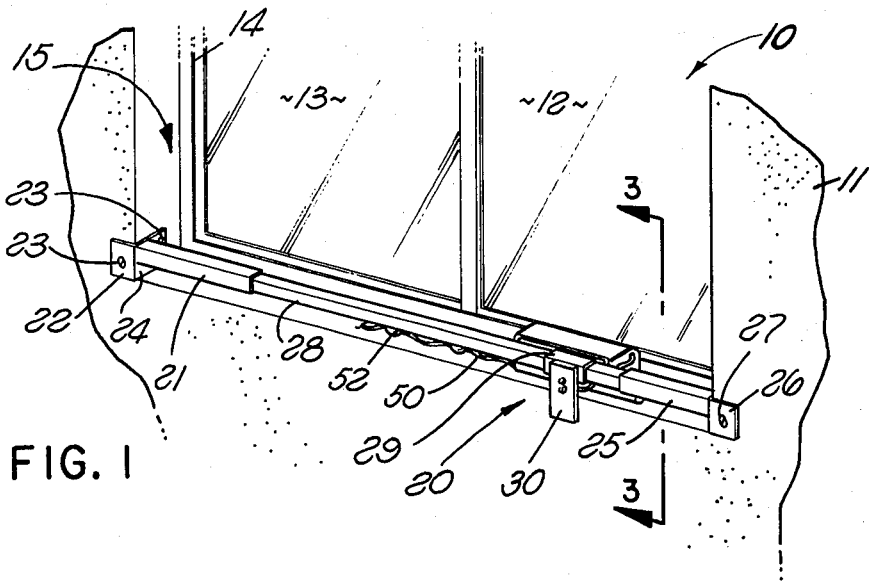
FIG. 1 is a partially broken-away perspective of a portion of a window area in a building showing a preferred embodiment of this apparatus in place within the window casement.

FIG. 1 illustrates a first preferred embodiment of the apparatus of this Invention in place and in storage when not used for an emergency.

The window casement area of a window, generally 10, is illustrated. Windows 12 and 13 are shown in place within window frame 14 in a customary manner. The window in use can be of any of many types of windows customarily used, preferably a window which will open. If a portion of the window will not open, the device can still be used in a fixed window area, but in that case, the glass must be broken out before use.

Normally, a window will have a recessed portion of the wall 15 about it. This provides a space for the mounting of the apparatus.

The apparatus, itself, is the mechansim generally 20. This mechanism comprises a center tubular member, preferably of square cross-section, although round cross-section can as well be used and other cross-sections can be used. One end of the rod of the tubular member 28 telescopes within tubular member 21 which is attached by welding, or the like, to bracket 24 which has an angular projection 22, as shown. A pair of holes 23 are provided for insertion of screws, or the like, to hold the same in place against the wall and within the window casement.

The other end of tubular member 28 telescopes within tubular member 25 which is fastened to a bracket basically identical (although mirror image) to bracket 22–24. In this case, only the portion corresponding to the portion 22 is visible in the drawing and the hole 27 is indicated. In both cases, a screw, or the like, will be holding the device in place.

A bracket comprising a tubular member 29, suitable to slide upon tubular member 28, is provided and it includes a welded, or otherwise firmly fastened, projection 30, as shown, to press against the wall adjacent the casement.

Figure 2:
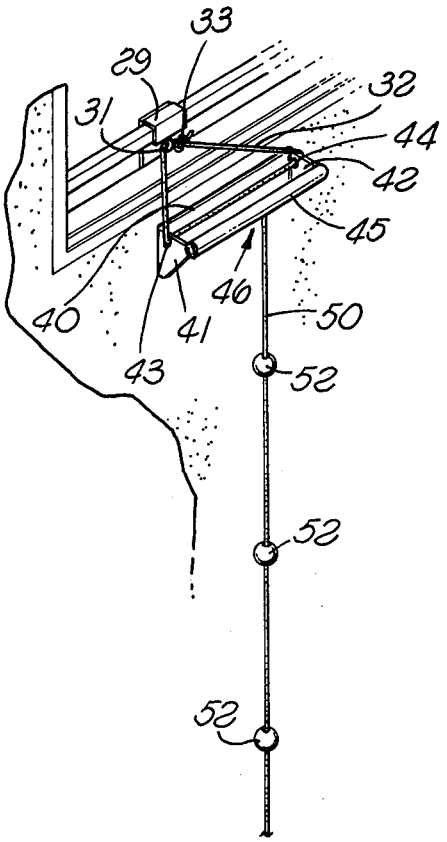
FIG. 2 is a view of the exterior of a portion of the window of FIG. 1 with a portion of the apparatus of FIG. 2 shown on the exterior side of the building with the device in condition for use for escape purposes.

A basic upper escape member is shown in place in FIG. 1 in its storage condition, and without the indication of numerals which will be shown in FIG. 2. The escape rope or cord 50, together with hand holds 52, however, are partially shown in storage position.

Figure 4:
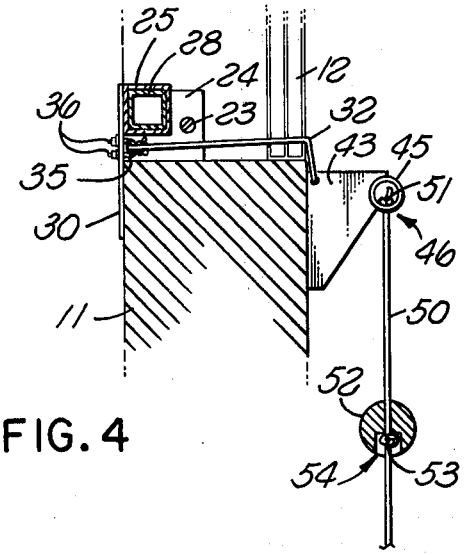
FIG. 4 is a section on the same location as FIG. 3 but with the apparatus shown in position for use as in FIG. 2.

Turning to FIG. 2, the exterior of the building is now shown. In this case, it will be seen that the cord 32 is connected to a U-bolt, or the like, by passing through the opening 31 in the U-bolt. The cord can be tied at 33, or otherwise connected, so as to make a continuous loop passing, as shown, through holes 43 and 44 inside brackets 41 and 42 connected to base plate 40. A tubular member, preferably round, 45 is connected between the brackets 41 and 42, as shown. It will be observed by examining FIG. 4 that the U-bolt 35 is held to tab 30 by customary nuts 36, or the like. It will also be observed in FIG. 4 that the cord 50 is held in firm contact to the rod 45 by passing through a hole 46 and having a knot, or the like, 51 tied on the interior so that it cannot slip out.

The hand holds 52 can be essentially wooden balls, or the like, having a hole drilled through them to accommodate the cord 50 and having a recessed enlarged opening in the bottom, as at 54, in order to accommodate a knot, or the like, 53 which obviously is larger than the hole through the ball and will hold the ball in position.

Figure 3:
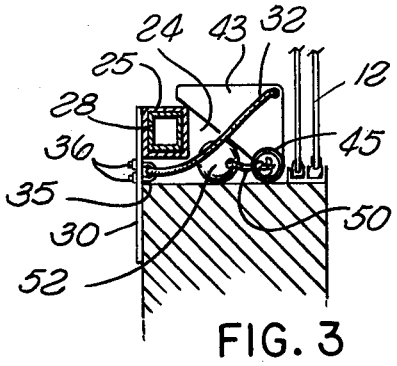
FIG. 3 is a section on 3—3 of FIG. 1.

FIG. 3, which has been passed over, shows some of the elements when the device is in storage. It will be noted that the bracket member 40–41–42–45 is stored neatly behind bar 28 and in front of the window so that it is essentially hidden from view.

With respect to the embodiment shown in FIGS. 1 through 4, it will be clear that, in its storage position, in case of an emergency, the windows are opened (or if fixed, they may be broken out completely) and the bracket arrangement 40–41–42–45 is dropped out the window. By natural forces of gravity and alignment, the cord 50 will drop downward and the device is ready to use. When using it, one will normally back out of the window feet first, and the member 45 provides an excellent hand hold for one or two hands in starting the descent. With the feet clasped together, various of the balls 52 can be used for foot support and, at the same time, will be used for hand support during the descent. By being arranged in this manner, one will have his hand or hands firmly gripped upon one or more of the balls 52 after descending a distance from the member 45 and will allow his feet to slide past one ball 52. He can then bring his feet together and will support himself on his feet at the next ball 52. At that point, his hand holds may be moved downward to the next ball and, thus, a safe and easy descent is accomplished.

Figure 5:
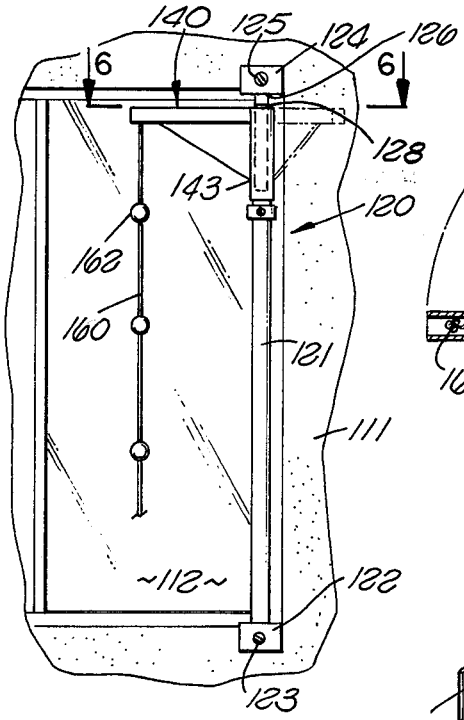
FIG. 5 is a partial elevational view of a window from the interior of a building with an alternate embodiment of this invention in place.

Turning to the embodiment of FIGS. 5, 6, 7, and 8, an alternate arrangement is shown by which the basic tubular member (in this case, preferably round) 121 is shown in place vertically within the window casement area 120 in wall 111. The tubular member 121 is welded, or otherwise firmly fastened, to a bracket 122 which is fastened by screws, or the like, 123 through holes in the member 122 to the wall. At the upper end (and FIG. 7 should be examined to understand this completely), a smaller size tubular member 126, telescopes within the member 121. This is for accommodating different lengths of the vertical height of the window and window casement. A bracket 124 is welded, or otherwise properly affixed, to the end of member 26. It is fastened by screws 125, or the like, through holes 129, or the like, to the wall as is shown in FIG. 5.

Figure 8:
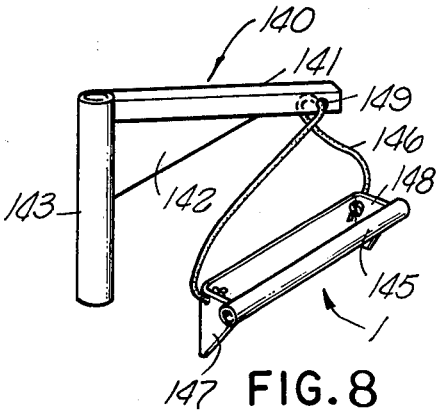
FIG. 8 is an enlarged perspective of an escape device mounting apparatus for use with the embodiment of FIG. 5.

The member, generally 140, (and this should be viewed in conjunction with FIG. 8) includes a tubular member 143 which mounts upon and over member 121 in a swiveling relationship. It is held in position by one of a number of customary means, including an item such as a collar 152 which will be held in place by a set screw, or the like, as is known to those skilled in the art. The gusset member 142 is welded, or otherwise fastened permanently, to the tubular member 143 and to tubular member 141. Tubular member 141 is shown as having a square cross-section, although this is not critical. There will be a hole, or the like, provided in the tubular member 141 at 149 through which a support cord 146, or the like, will be threaded. This cord may fasten to a bracket 147–148–145, or the like, and may even be utilized to support a ladder, if desired. Such arrangement is shown in FIG. 8. The preferred arrangement, however, is that shown in FIGS. 5 and 6 wherein a single hole in the bottom of the member 141 is utilized for the purpose of passing the cord through that hole and having a knot 161, or other means to prevent the cord from slipping back through the hole. The cord 160, then, will preferably have ball supports of the nature shown in the embodiment of FIGS. 1 through 4 and arranged in the same manner.

In storage condition, this apparatus can be stored either as shown in FIG. 5, but with the escape cord pulled back against the member 121 so as to be out of the way of the window, or it may be swung completely around so that the upper portion extends into the interior of the building as indicated by the phantom lines of FIG. 5. In this latter case, it will be normally hidden from view by curtains, or the like, along the edge of the window.

Figure 6:
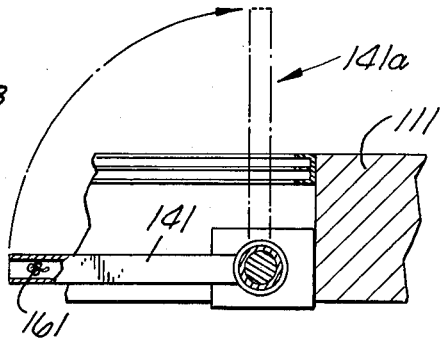
FIG. 6 is a section on 6—6 of FIG. 5.
Figure 7:
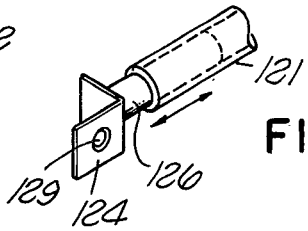
FIG. 7 is a partial view of elements at the upper portion of the support rod 121 of FIG. 5, enlarged, and without the actual escape device in place.

In use, this device will be swung out, as shown by the phantom lines 141*a* in FIG. 6, and one will stand in the window opening to commence the descent, gripping the upper balls, or the like, with his hands and then moving his feet out onto the rope.

Figure 10:
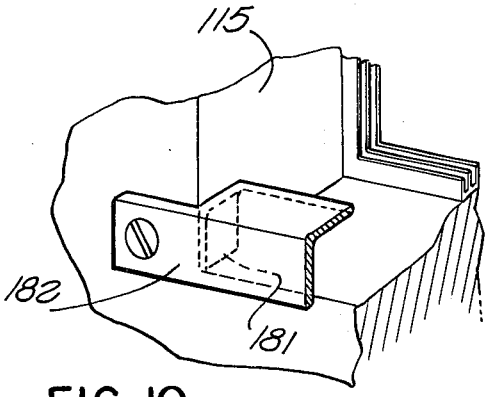
FIG. 10 is a partially broken-away perspective of an area of a window wherein the mounting arrangement of FIG. 9 is in use within the window casement.
Figure 9:
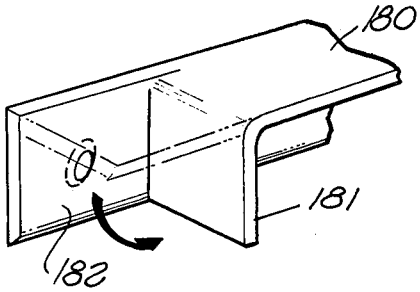
FIG. 9 is an enlarged view of the end mounting area of an alternate embodiment of the mounting bar of the apparatus of FIG. 1.

A final alternate embodiment for neatness of operation of the apparatus of FIG. 1, particularly, is shown in FIGS. 9 and 10. In this case, the bar support apparatus 28–21–25 of FIG. 1 will be replaced by a single angle shaped member 180. Each end of the angle shaped member will be formed as is shown in FIGS. 9 and 10 with a short portion of the upper part of member 180 turned downward as at 181 in the form of a tab. The apparatus is then fastened to the two edges of the casement in place of the members 22 and 26.

It will be observed that FIG. 9 illustrates the end of such an apparatus for the right side of the illustration of FIG. 1, and FIG. 10 illustrates the apparatus for the left side of the apparatus of FIG. 1. The rest of the apparatus will operate as previously described.

It is understood that we have stressed the use of a single cord with balls or other suitable devices at spaced intervals in this apparatus. It has also been found that other means can be used even to the point of using a flexible ladder which can be stored behind the support bar or various different types hand holds and the like. Rings and the like may easily be used, and it is conceivable to have a combination of hand hold rings and foot support members, or the like.

While the embodiments of this invention shown and described are fully capable of achieving the objects and advantages of this invention, it is to be understood that such embodiments have been shown for purposes of illustration only, and not for purposes of limitation.

We claim:

1. Emergency building escape means comprising in combination: (1) elongated, length adjustable first support means suitable to be attached to a wall primarily within a window casement; (2) second support means slideably connected to said first support means in such manner as to be moveable over the width of the opening; (3) third support means comprising the combination of means to contact the exterior wall adjacent said window together with hand hold means attached thereto attached to said second support means; (3) third support means comprising an elongated flexible member fastened to said hand hold means and including means for gripping the same by human hands for the purpose of slow descent on the exterior of the building from said opening.

2. Apparatus for emergency escape from a building, with an opening in the said building, at an elevation above the ground level, comprising in combination: (1) First support means comprising elongated support means fastened within a window casement in a vertical position wherein the window is the opening in the building; (2) Second support means including bracket means supported by the said first support means and exterior wall contact means connected to the said bracket means, wherein said second support means is adaptable to be stored within said building or to pass through said opening to the exterior of said building; (3) Third support means attached to said wall contact means, said third support means including at least one elongated flexible cord means carrying a plurality of spaced apart spherically shaped hand hold means, and wherein said third support means is suitable to be stored within the building with the second support means is within the building and suitable to extend vertically downward alongside the outside of said building when said second support means is located outside the building.

3. The apparatus of claim 2 wherein the said second support means is connected to the said first support means in a swiveling relationship.

* * * * *